US010710364B2

(12) United States Patent
Takamura

(10) Patent No.: US 10,710,364 B2
(45) Date of Patent: Jul. 14, 2020

(54) LIQUID DISCHARGE HEAD AND PRINTER

(71) Applicant: TOSHIBA TEC KABUSHIKI KAISHA, Shinagawa-ku, Tokyo (JP)

(72) Inventor: Jun Takamura, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/243,148

(22) Filed: Jan. 9, 2019

(65) Prior Publication Data

US 2019/0210365 A1 Jul. 11, 2019

(30) Foreign Application Priority Data

Jan. 10, 2018 (JP) ..... 2018-001907

(51) Int. Cl.
*B41J 2/045* (2006.01)

(52) U.S. Cl.
CPC ..... *B41J 2/04588* (2013.01); *B41J 2/04581* (2013.01); *B41J 2202/10* (2013.01)

(58) Field of Classification Search
CPC . B41J 2/04588; B41J 2/04581; B41J 2002/10
See application file for complete search history.

(56) References Cited

U.S. PATENT DOCUMENTS 5,521,619 A * 5/1996 Suzuki ..... B41J 2/04541 347/10
6,106,092 A * 8/2000 Norigoe ..... B41J 2/04581 347/11
9,205,647 B2 12/2015 Ichikawa
2016/0016401 A1* 1/2016 Hiyoshi ..... B41J 2/04581 347/10
2018/0086055 A1 3/2018 Takamura
2018/0345661 A1 12/2018 Takamura et al.

* cited by examiner

*Primary Examiner* — Sharon A. Polk
(74) *Attorney, Agent, or Firm* — Amin, Turocy & Watson, LLP

(57) ABSTRACT

In accordance with an embodiment, a liquid discharge head comprises an actuator and a controller. The actuator drives a pressure chamber, which is filled with liquid and communicates with a nozzle in which a meniscus of the liquid is formed. The controller applies an acceleration pulse for accelerating vibration of the meniscus to the actuator after applying a discharge pulse for discharging the liquid in the pressure chamber from the nozzle.

18 Claims, 9 Drawing Sheets

LIQUID DISCHARGE HEAD AND PRINTER

CROSS-REFERENCE TO RELATED APPLICATION

This application is based upon and claims the benefit of priority from Japanese Patent Application No. P2018-001907, filed Jan. 10, 2018, the entire contents of which are incorporated herein by reference.

FIELD

Embodiments described herein relate generally to a liquid discharge head and a printer.

BACKGROUND

An inkjet head (liquid discharge head) of an image forming apparatus discharges ink droplets from a nozzle communicating with a pressure chamber by driving the pressure chamber filled with ink. If the inkjet head discharges ink droplets, trailing portion extending from the ink droplets towards a direction of a meniscus of the ink may be undesirably formed in some cases.

Conventionally, satellite or mist may occur in the inkjet head due to the trailing portion, leading to deterioration in a printing quality.

DETAILED DESCRIPTION

In accordance with an embodiment, a liquid discharge head comprises an actuator and a controller. The actuator drives a pressure chamber, which is filled with liquid and communicates with a nozzle in which a meniscus of the liquid is formed. The controller applies an acceleration pulse for accelerating vibration of the meniscus to the actuator after applying a discharge pulse for discharging the liquid in the pressure chamber from the nozzle.

Hereinafter, a printer according to an embodiment is described with reference to the accompanying drawings.

The printer according to the embodiment forms an image on a medium such as a sheet using an inkjet head. The printer discharges ink in a pressure chamber of the inkjet head onto a medium to form an image on the medium. The printer 200 is, for example, a printer used in an office, a barcode printer, a printer for POS (Point of Sales), a printer for industry, a 3D (three-dimensional) printer, or the like. The medium on which the printer forms an image is not limited to having a specific configuration. The inkjet head included in the printer according to the embodiment is an example of a liquid discharge head, and the ink is an example of a liquid.

Figure 1:
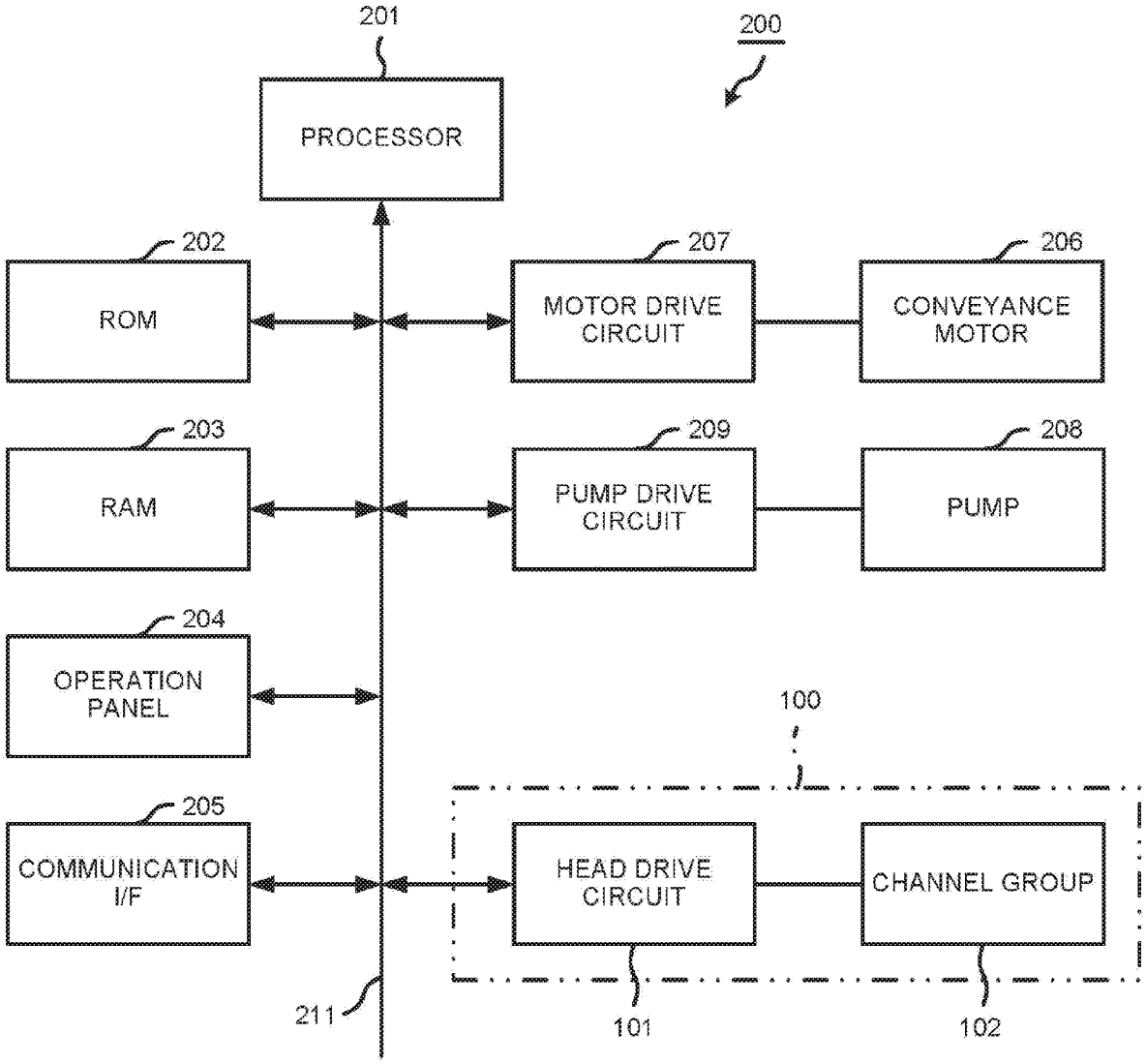
FIG. 1 is a block diagram illustrating an example of a configuration of an inkjet printer according to an embodiment.

FIG. 1 is a block diagram illustrating an example of a configuration of the printer 200.

As shown in FIG. 1, the printer 200 includes a processor 201, a ROM (Read Only Memory) 202, a RAM (Random Access Memory) 203, an operation panel 204, a communication interface 205, a conveyance motor 206, a motor drive circuit 207, a pump 208, a pump drive circuit 209, and an inkjet head 100. The printer 200 includes a bus line 211 such as an address bus and a data bus. The processor 201 is connected to the ROM 202, the RAM 203, the operation panel 204, the communication interface 205, the motor drive circuit 207, the pump drive circuit 209, and a head drive circuit 101 of the inkjet head 100 via the bus line 211 directly or via an input/output circuit. The motor drive circuit 207 is connected to the conveyance motor 206. The pump drive circuit 209 is connected to the pump 208.

The printer 200 may further have a component as necessary in addition to the components shown in FIG. 1, or may exclude a specific component from the printer 200.

The processor 201 has a function of controlling the operation of the entire printer 200. The processor 201 may include an internal cache and various interfaces. The processor 201 realizes various processing by executing programs stored in advance in the internal cache and the ROM 202. The processor 201 realizes various functions of the printer 200 by executing an operating system, application programs, and the like.

A part of the various functions realized by the processor 201 executing the programs may be realized by a hardware circuit. In this case, the processor 201 controls functions to be realized by the hardware circuit.

The ROM 202 is a nonvolatile memory in which a control program, control data and the like are stored in advance. The control program and the control data stored in the ROM 202 are incorporated in advance according to a specification of the printer 200. For example, the ROM 202 stores the operating system, application programs, and the like.

The RAM 203 is a volatile memory. The RAM 203 temporarily stores data being processed by the processor 201 and the like. The RAM 203 stores various application programs based on commands from the processor 201. The RAM 203 may store data necessary for executing an application program, an execution result of the application program, and the like. The RAM 203 may function as an image memory in which print data is copied or decompressed.

The operation panel 204 is used for receiving input of an instruction from an operator and displaying various kinds of information to the operator. The operation panel 204 includes an operation section for receiving an input of an instruction and a display section for displaying information.

The operation panel 204 transmits a signal indicating an operation received from the operator to the processor 201 as an operation of the operation section. For example, the operation section includes function keys such as a power key, a sheet feed key, an error release key and the like.

The operation panel 204 displays various kinds of information under the control of the processor 201 as the operation of the display section. For example, the operation panel 204 displays a state of the printer 200 and the like. For example, the display section may be a liquid crystal monitor.

The operation section may be a touch panel. In this case, the display section may be formed integrally with the touch panel which is the operation section.

The communication interface 205 is used for transmitting and receiving data to and from an external device via a network such as a LAN (Local Area Network). For example, the communication interface 205 supports a LAN connection. For example, the communication interface 205 receives print data from a client terminal via the network. For example, when an error occurs in the printer 200, the communication interface 205 transmits a signal for notifying the error to the client terminal.

The motor drive circuit 207 controls driving of the conveyance motor 206 in response to a signal from the processor 201. For example, the motor drive circuit 207 transmits electric power or a control signal to the conveyance motor 206.

Under the control of the motor drive circuit 207, the conveyance motor 206 functions as a driving source of a conveyance mechanism for conveying a medium such as a printing sheet. When the conveyance motor 206 is driven, the conveyance mechanism starts conveying the medium. The conveyance mechanism conveys the medium to a printing position by the inkjet head 100. The conveyance mechanism discharges the medium after printing to the outside of the printer 200 from a discharge port (not shown).

The motor drive circuit 207 and the conveyance motor 206 constitute a conveyance section for conveying the medium.

The pump drive circuit 209 controls driving of the pump 208. When the pump 208 is driven, the ink is supplied from an ink tank to the inkjet head 100.

The inkjet head 100 discharges ink droplets onto the medium based on the print data. The inkjet head 100 includes the head drive circuit 101, a channel group 102, and the like.

Below, the inkjet head according to the embodiment is described with reference to the accompanying drawings. In the embodiment, a share mode type inkjet head 100 (refer to FIG. 2) is exemplified. The inkjet head 100 discharges the ink onto a sheet. The medium onto which the inkjet head 100 discharges the ink is not limited to having a specific configuration.

Figure 2:
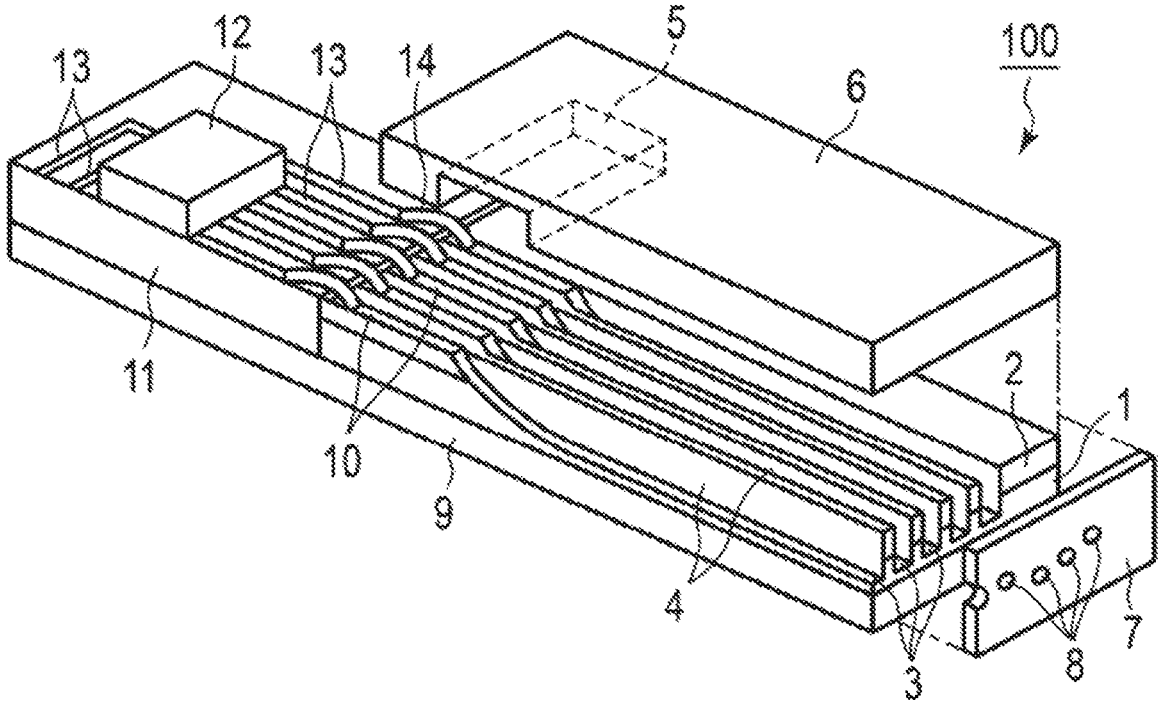
FIG. 2 is a perspective view illustrating an inkjet head according to the embodiment.
Figure 3:
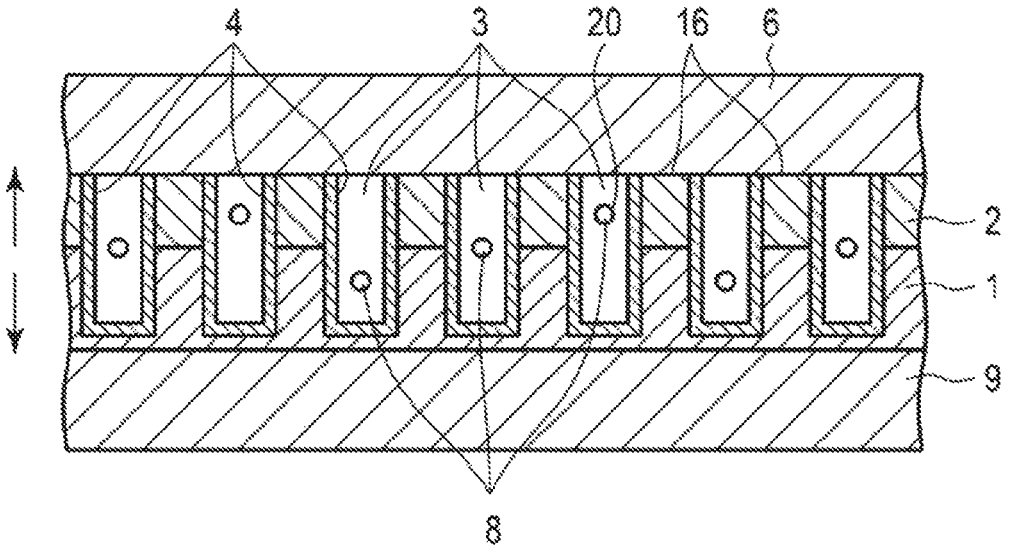
FIG. 3 is a transverse sectional view of the inkjet head according to the embodiment.
Figure 4:
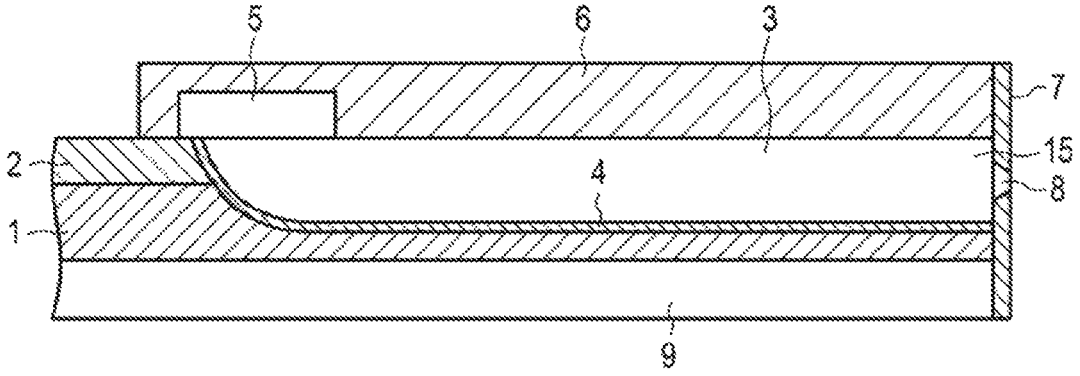
FIG. 4 is a longitudinal sectional view of the inkjet head according to the embodiment.

Next, the configuration of the inkjet head 100 is described with reference to FIG. 2 to FIG. 4. FIG. 2 is a perspective view illustrating a part of the inkjet head 100 in an exploded manner. FIG. 3 is a transverse sectional view of the inkjet head 100. FIG. 4 is a longitudinal sectional view of the inkjet head 100.

The inkjet head 100 has a base plate 9. In the inkjet head 100, a first piezoelectric member 1 is bonded to an upper surface of the base plate 9, and a second piezoelectric member 2 is bonded to an upper surface of the first piezoelectric member 1. The first piezoelectric member 1 and the second piezoelectric member 2 bonded to each other are polarized in mutually opposite directions in a plate thickness direction, as indicated by arrows in FIG. 3.

The base plate 9 is made of a material having a small dielectric constant and a small difference in thermal expansion coefficient with the first piezoelectric member 1 and the second piezoelectric member 2. As the material of the base plate 9, for example, alumina ($Al_2O_3$), silicon nitride ($Si_3N_4$), silicon carbide (SiC), aluminum nitride (AlN), lead titanate zirconate (PZT) or the like is preferable. As the material of the first piezoelectric member 1 and the second piezoelectric member 2, lead zirconate titanate (PZT), lithium niobate ($LiNbO_3$), lithium tantalate ($LiTaO_3$) or the like is provided.

In the inkjet head 100, a large number of elongated grooves 3 are provided from a front end side to a rear end side of each of the first piezoelectric member 1 and the second piezoelectric member 2 bonded to each other. The grooves 3 are arranged in parallel at a certain interval therebetween. Each groove 3 is arranged with a front end thereof open and a rear end thereof inclined upwards.

In the inkjet head 100, electrodes 4 are provided on side walls and a bottom surface of each groove 3. The electrode 4 has a two-layer structure composed of nickel (Ni) and gold (Au). Each groove 3 is coated uniformly by the electrode 4 by, for example, a plating method. A method of forming the electrode 4 is not limited to the plating method. For example, a sputtering method, an evaporation method, or the like may also be used.

The inkjet head 100 is provided with an extraction electrode 10 from the rear end of each groove 3 towards the upper surface of a rear portion of the second piezoelectric member 2. The extraction electrode 10 extends from the electrode 4.

The inkjet head 100 includes a top plate 6 and an orifice plate 7. The top plate 6 seals an upper portion of each groove 3. The orifice plate 7 seals the front end of each groove 3. In the inkjet head 100, a plurality of pressure chambers 15 is formed by the grooves 3 surrounded by the top plate 6 and the orifice plate 7. The pressure chamber 15 is filled with the ink supplied from the ink tank. The pressure chamber 15 has a shape in which a depth thereof is 300 μm and a width thereof is 80 μm, for example, and a plurality of pressure chambers 15 is arranged in parallel at a pitch of 169 μm. Such a pressure chamber 15 is also called an ink chamber.

The top plate 6 has a common ink chamber 5 at a rear portion of the inside thereof. The orifice plate 7 has nozzles 8 at positions facing respective grooves 3. The nozzle 8 communicates with the groove 3 facing thereto or the pressure chamber 15. The nozzle 8 has a tapered shape from the pressure chamber 15 side towards an ink discharge side on the opposite side. The nozzles 8 corresponding to three adjacent pressure chambers 15 are assumed as one set, and a plurality of nozzles 8 is formed by being shifted at a certain interval in a height direction of the groove 3 (vertical direction of the paper surface in FIG. 3).

If the pressure chamber 15 is filled with the ink, a meniscus 20 of the ink is formed in the nozzle 8. The meniscus 20 is formed along an inner wall of the nozzle 8.

A piezoelectric member constituting a partition wall of the pressure chamber 15 is sandwiched by the electrodes 4 provided in the pressure chambers 15 to form an actuator 16 for driving the pressure chamber 15.

In the inkjet head 100, a printed board 11 on which a conductive pattern 13 is formed is bonded to an upper surface on the rear side of the base plate 9. In the inkjet head 100, a driver IC (Integrated Circuit) 12 on which the head drive circuit 101 (controller) described later is mounted is installed on the printed board 11. The driver IC 12 is connected to the conductive pattern 13. The conductive pattern 13 is bonded to each extraction electrode 10 via a conductor 14 by wire bonding.

A group composed of the pressure chamber 15, the electrode 4 and the nozzle 8 of the inkjet head 100 is referred to as a channel. The inkjet head 100 has channels ch. 1, ch. 2, . . . , ch. N, of which the total number is equal to the number N of the grooves 3.

Next, the head drive circuit 101 is described.

Figure 5:
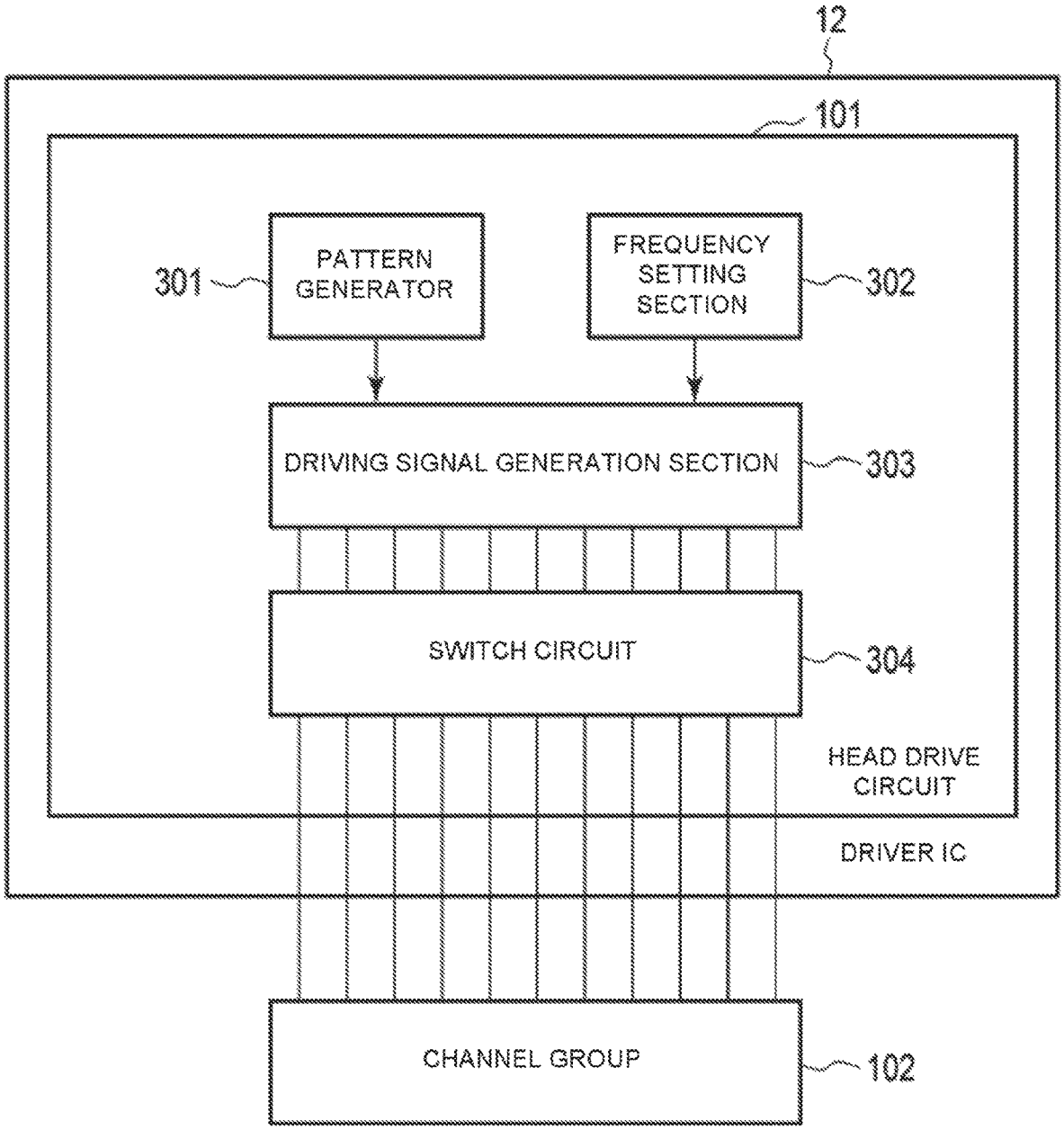
FIG. 5 is a block diagram illustrating an example of a configuration of a head drive circuit according to the embodiment.

FIG. 5 is a block diagram illustrating an example of a configuration of the head drive circuit 101. As described above, the head drive circuit 101 is installed in the driver IC 12.

The head drive circuit 101 drives a channel group 102 of the inkjet head 100 based on the print data.

The channel group 102 includes a plurality of channels (ch 1, ch. 2, . . . , ch. N) composed of the pressure chamber 15, the electrode 4 and the nozzle 8. Specifically, based on a control signal from the head drive circuit 101, the channel group 102 discharges the ink by an operation of each pressure chamber 15 expanded and contracted by the actuator 16.

As shown in FIG. 5, the head drive circuit 101 includes a pattern generator 301, a frequency setting section 302, a driving signal generation section 303, and a switch circuit 304.

The pattern generator 301 generates various waveform patterns using a waveform pattern of an expansion pulse signal for expanding a volume of the pressure chamber 15, a resting period in which the volume of the pressure chamber is released, and a contraction pulse signal for contracting the volume of the pressure chamber 15.

The pattern generator 301 generates a waveform pattern of a discharge pulse signal (discharge signal) for discharging one ink droplet. The discharge pulse signal is constituted by an expansion pulse signal for a predetermined period of time and a contraction pulse signal for a predetermined period of time. A sum of a width of the expansion pulse signal and a width of the contraction pulse signal in the discharge pulse signal is a section for discharging one ink droplet, i.e., a so-called one drop cycle.

The pattern generator 301 generates a waveform pattern of a cancellation pulse signal for suppressing vibration of the meniscus 20. The cancellation pulse signal is constituted by an expansion pulse signal for a predetermined period of time. The cancellation pulse signal may also be constituted by a contraction pulse for a predetermined period of time.

The pattern generator 301 generates a waveform pattern of an acceleration pulse signal for accelerating vibration of the meniscus 20. The acceleration pulse signal is formed by the contraction pulse signal for a predetermined period of time.

The frequency setting section 302 sets a driving frequency of the inkjet head 100. The driving frequency is a frequency of a driving pulse generated by the driving signal generation section 303. The head drive circuit 101 operates in response to a driving pulse.

The driving signal generation section 303 generates a pulse signal for each channel according to the print data input through the bus line based on the waveform pattern generated by the pattern generator 301 and the driving frequency set by the frequency setting section 302. The pulse signal for each channel is output from the driving signal generation section 303 to the switch circuit 304.

The switch circuit 304 switches a voltage to be applied to the electrode 4 of each channel in response to the pulse signal for each channel output from the driving signal generation section 303. Specifically, the switch circuit 304 applies a voltage to the actuator 16 of each channel based on an energization time of the expansion pulse signal or the like that is set by the pattern generator 301.

By switching the voltage, the switch circuit 304 expands or contracts the volume of the pressure chamber 15 of each channel to discharge ink droplets, the number of which is equal to the number of gradations, from the nozzle 8 of each channel.

Next, an operation principle of the inkjet head 100 configured as described above is described with reference to FIG. 6 to FIG. 8.

Figure 6:
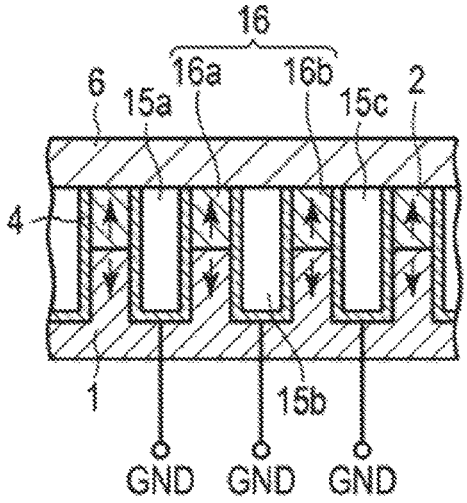
FIG. 6 is a diagram illustrating an example of an operation executed by the inkjet head according to the embodiment.

FIG. 6 shows a state of the pressure chamber 15*b* in the resting period. As shown in FIG. 6, in the head drive circuit 101, potentials of the electrodes 4 arranged on the respective wall surfaces of a pressure chamber 15*b* and pressure chambers 15*a* and 15*c* adjacent to the pressure chamber 15*b* are all set to a ground potential GND. In this state, the deformation does not occur in a partition wall 16*a* sandwiched between the pressure chamber 15*a* and the pressure chamber 15*b* and a partition wall 16*b* sandwiched between the pressure chamber 15*b* and the pressure chamber 15*c*.

Figure 7:
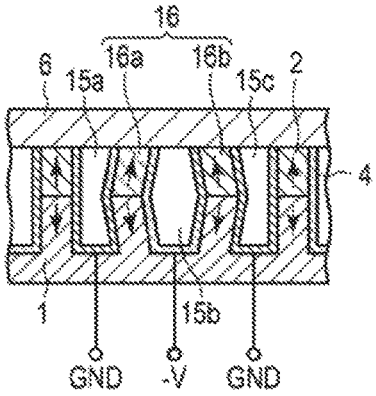
FIG. 7 is a diagram illustrating an example of an operation executed by the inkjet head according to the embodiment.

FIG. 7 shows an example of a state in which the head drive circuit 101 applies the expansion pulse signal to the actuator 16 of the pressure chamber 15*b*. As shown in FIG. 7, the head drive circuit 101 applies a negative voltage −V to the electrode 4 of the central pressure chamber 15*b* while the potentials of the electrodes 4 of the pressure chambers 15*a* and 15*c* adjacent to the pressure chamber 15*b* are both the ground potential GND. In this state, an electric field of the voltage V acts on each of the partition walls 16*a* and 16*b* in a direction orthogonal to a polarization direction of the first piezoelectric member 1 and the second piezoelectric member 2. Due to this action, each of the partition walls 16*a* and 16*b* is deformed outward to expand the volume of the pressure chamber 15*b*.

Figure 8:
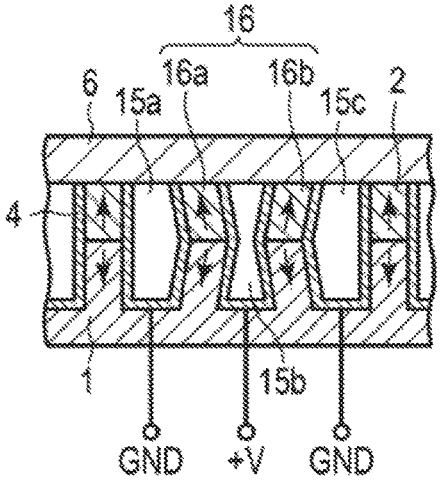
FIG. 8 is a diagram illustrating an example of an operation executed by the inkjet head according to the embodiment.

FIG. 8 shows an example in which the head drive circuit 101 applies the contraction pulse signal to the actuator 16 of the pressure chamber 15*b*. As shown in FIG. 8, the head drive circuit 101 applies a positive voltage +V to the electrode 4 of the central pressure chamber 15*b* while potentials of the electrodes 4 of both the adjacent pressure chambers 15*a* and 15*c* are the ground potential GND. In this state, an electric field of the voltage V acts on each of the partition walls 16*a* and 16*b* in a direction opposite to the state shown in FIG. 7. By this action, the partition walls 16*a* and 16*b* deform inward so as to contract the volume of the pressure chamber 15*b*.

When the volume of the pressure chamber 15*b* is expanded or contracted, the pressure vibration occurs in the pressure chamber 15*b*. Due to the pressure vibration, the pressure in the pressure chamber 15*b* increases, and ink droplets are discharged from the nozzle 8 communicating with the pressure chamber 15*b*.

As described above, the partition walls 16*a* and 16*b* separating the pressure chambers 15*a*, 15*b* and 15*c* become the actuator 16 for applying the pressure vibration to the inside of the pressure chamber 15*b* with the partition walls 16*a* and 16*b* as wall surfaces thereof. In other words, the pressure chamber 15 is contracted or expanded by the operation of the actuator 16.

Each of the pressure chambers 15 shares the actuator 16 (partition wall) with an adjacent pressure chamber 15. For this reason, the head drive circuit 101 cannot individually drive each pressure chamber 15. The head drive circuit 101 divides the pressure chambers 15 by dividing them into (n+1) (n is an integer of two or more) groups every (n+1) pressure chambers 15 to drive them. In the present embodiment, a case of a so-called three-division driving in which the head drive circuit 101 drives the pressure chambers 15 by dividing them into three groups every three pressure chambers 15 is exemplified. The three-division driving is merely an example, and a four-division driving or a five-division driving may be used.

Next, an example of signals to be applied to the actuator 16 (partition walls 16*a* and 16*b*) of the pressure chamber 15 by the head drive circuit 101 is described.

First, the head drive circuit 101 discharges one ink droplet from the pressure chamber 15.

Figure 9:
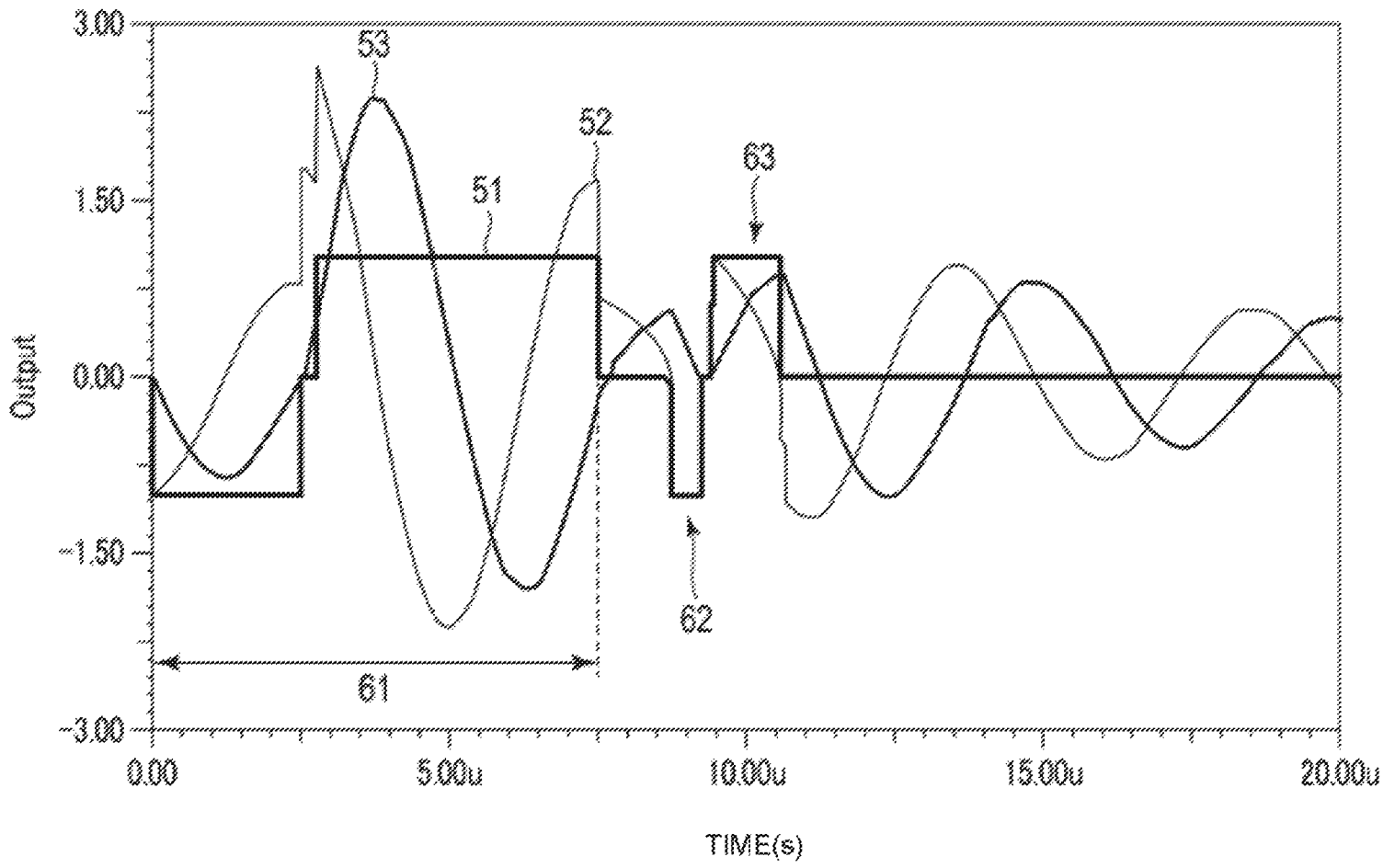
FIG. 9 is a timing chart of pulses applied to an actuator according to the embodiment.

FIG. 9 is a timing chart illustrating an example of signals to be applied to the actuator 16 of the pressure chamber 15 by the head drive circuit 101. FIG. 9 shows a graph 51, a graph 52 and a graph 53.

The graph 51 shows a voltage of the signal to be applied to the actuator 16 of the pressure chamber 15 by the head drive circuit 101. Here, the graph 51 shows that the expansion pulse signal is applied when it is on a minus side, and that the contraction pulse signal is applied when it is on a plus side.

The graph 52 shows the pressure in the pressure chamber 15. Specifically, the graph 52 shows the pressure generated in the ink in the pressure chamber 15.

The graph 53 shows a flow velocity of the meniscus 20. Here, in the graph 53, a plus direction refers to a direction from the pressure chamber 15 to the outside. Specifically, the graph 53 shows that the meniscus 20 moves towards the inside of the pressure chamber 15 when it is on the minus side. The graph 53 shows that the meniscus 20 moves towards the outside of the pressure chamber 15 from the pressure chamber 15 when it is on the plus side.

As shown in FIG. 9, the head drive circuit 101 sequentially applies the discharge pulse signal 61, the cancellation pulse signal 62 and the acceleration pulse signal 63 to the actuator 16.

First, the head drive circuit 101 applies the discharge pulse signal 61. As described above, the discharge pulse signal 61 is constituted by the expansion pulse signal and the contraction pulse signal.

If the discharge pulse signal 61 is applied to the actuator 16, the pressure chamber 15 is expanded to a predetermined volume in response to the expansion pulse signal. The pressure chamber 15 is filled with the ink therein due to the expansion. After a predetermined period of time has elapsed, the pressure chamber 15 is released. If the pressure chamber 15 is released, the contraction pulse signal is applied to the actuator 16. If the contraction pulse signal is applied to the actuator 16, the pressure chamber 15 is contracted to a predetermined volume in response to the contraction pulse signal.

While the contraction pulse signal is being applied to the actuator 16, a flow velocity of the meniscus 20 exceeds a threshold value (discharge threshold value) at which the ink droplets are discharged. At a timing at which the flow velocity of the meniscus 20 exceeds the discharge threshold value, the pressure chamber 15 discharges the ink droplets through the nozzle 8.

If the discharge pulse signal 61 is applied, the head drive circuit 101 applies the cancellation pulse signal 62 to the actuator 16. The head drive circuit 101 applies the cancellation pulse signal 62 at a timing at which the flow velocity of the meniscus 20 is suppressed. For example, the head drive circuit 101 applies the cancellation pulse signal 62 while the flow velocity of the meniscus 20 is increasing (or while being on the plus side).

If the cancellation pulse signal 62 is applied, the head drive circuit 101 applies the acceleration pulse signal 63 to the actuator 16 at a predetermined timing. For example, the head drive circuit 101 applies the acceleration pulse signal 63 immediately after the cancellation pulse signal is applied. If the acceleration pulse signal 63 is applied to the actuator 16, the pressure chamber 15 is contracted to a predetermined volume in response to the acceleration pulse signal 63. As a result, the flow velocity of the meniscus 20 increases.

The acceleration pulse signal 63 is a signal for increasing the flow velocity of the meniscus 20 to a predetermined velocity without discharging the ink droplet. If the acceleration pulse signal 63 increases the flow velocity of the meniscus 20 to 65% or more of a peak, there is a possibility of discharging the ink droplet erroneously. If the acceleration pulse signal 63 increases the flow velocity of the meniscus 20 only to 30% or less of the peak, it is not possible to prevent a trailing portion of the ink droplet. Therefore, the acceleration pulse signal 63 increases the flow velocity of the meniscus 20 from 30% to 65% of the peak of the velocity generated according to the discharge pulse signal.

The acceleration pulse signal 63 may increase the flow velocity of the meniscus 20 from 30% to 65% of the discharge threshold value.

Next, a case in which the head drive circuit 101 discharges a plurality of ink droplets from the pressure chamber 15 is described.

Figure 10:
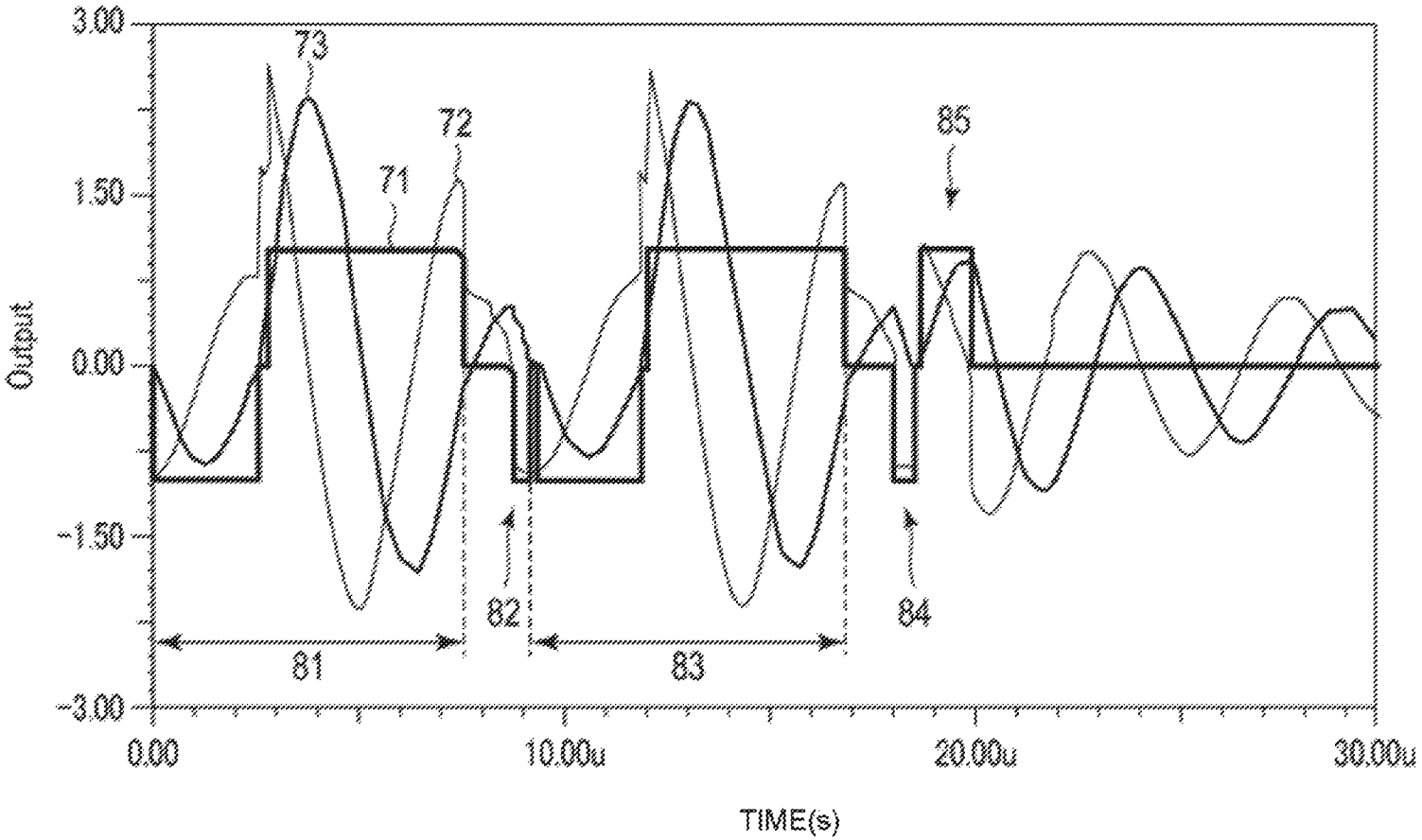
FIG. 10 is a timing chart of pulses applied to the actuator according to the embodiment.

FIG. 10 is a timing chart illustrating an example of signals to be applied to the actuator 16 of the pressure chamber 15 by the head drive circuit 101. FIG. 10 shows a graph 71, a graph 72 and a graph 73.

The graph 71 shows a voltage of the signal to be applied to the actuator 16 of the pressure chamber 15 by the head drive circuit 101. The graph 72 shows a pressure in the pressure chamber 15. The graph 73 shows a flow velocity of the meniscus 20.

As shown in FIG. 10, the head drive circuit 101 sequentially applies a discharge pulse signal 81, a cancellation pulse signal 82, a discharge pulse signal 83, a cancellation pulse signal 84 and an acceleration pulse signal 85 to the actuator 16. Specifically, the head drive circuit 101 applies the acceleration pulse signal after applying a plurality of the discharge pulse signals.

When the discharge pulse signal 81 is applied to the actuator 16, the pressure chamber 15 discharges the ink droplet through the nozzle 8.

After the discharge pulse signal 81 is applied, the head drive circuit 101 applies the cancellation pulse signal 82 at a timing at which the flow velocity of the meniscus 20 is suppressed.

After the cancellation pulse signal 82 is applied, the head drive circuit 101 applies the discharge pulse signal 83 at a predetermined timing. When the discharge pulse signal 83 is applied to the actuator 16, the pressure chamber 15 discharges the ink droplet through the nozzle 8.

After the discharge pulse signal 83 is applied, the head drive circuit 101 applies the cancellation pulse signal 84 at a timing at which the flow velocity of the meniscus 20 is suppressed. After the cancellation pulse signal 84 is applied, the head drive circuit 101 applies the acceleration pulse signal 85 at a predetermined timing.

The head drive circuit 101 may apply three or more discharge pulse signals. The number of the discharge pulse signals applied by the head drive circuit 101 is not limited to a specific number.

Next, the ink droplet discharged by the inkjet head 100 is described.

Figure 11:
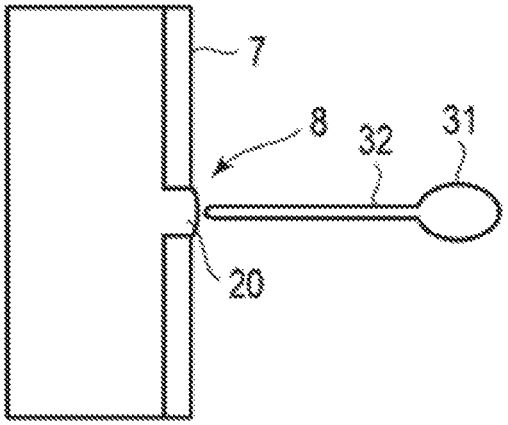
FIG. 11 is a diagram illustrating an example of an ink droplet discharged from the inkjet head according to the embodiment.

FIG. 11 shows the state of the ink droplet after the head drive circuit 101 applies the discharge pulse signal and the cancellation pulse signal to the actuator 16.

As shown in FIG. 11, the inkjet head 100 discharges the ink droplet 31. The ink droplet 31 flies while being connected to a trailing portion 32 from the meniscus 20. As a result, the trailing portion 32 extending from the meniscus 20 to the ink droplet 31 is formed.

Figure 12:
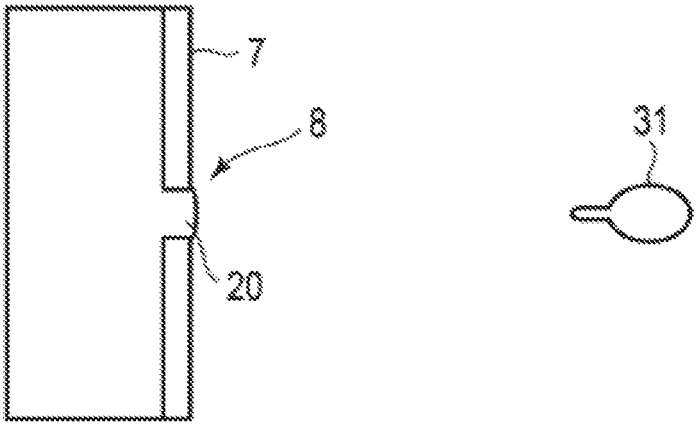
FIG. 12 is a diagram illustrating an example of an ink droplet discharged from the inkjet head according to the embodiment.

FIG. 12 shows a state of the ink droplet after the head drive circuit 101 applies the acceleration pulse signal to the actuator 16.

If the acceleration pulse signal is applied to the actuator 16, the flow velocity of the meniscus 20 increases. Specifically, the meniscus 20 is pushed out from the pressure chamber 15 to the outside of the pressure chamber 15. Therefore, the meniscus 20 pushes out the trailing portion 32 connected thereto to the outside. As a result, as shown in FIG. 12, the trailing portion 32 is separated from the meniscus 20 and absorbed by the ink droplet 31.

Next, a state of the ink droplet in a conventional art is described for comparison.

Figure 13:
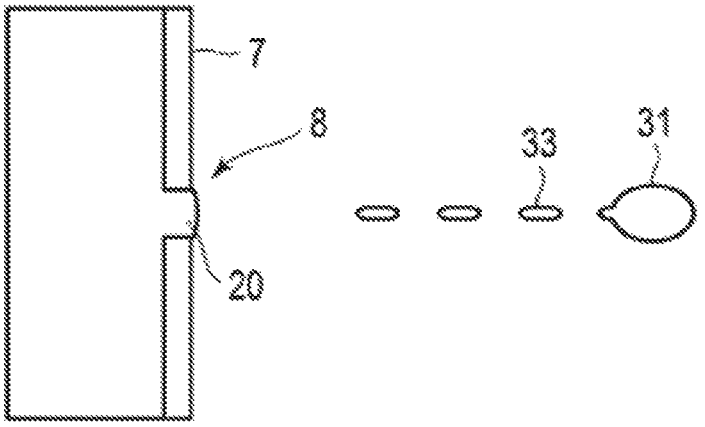
FIG. 13 is a diagram illustrating an example of ink droplets discharged from a conventional inkjet head.

FIG. 13 is a diagram illustrating an example of a state in which the ink droplets are flying. In the example shown in FIG. 13, the head drive circuit 101 does not apply the acceleration pulse.

Since the head drive circuit 101 does not apply the acceleration pulse, the meniscus 20 is not pushed out from the pressure chamber 15 to the outside of the pressure chamber 15 after discharging the ink droplet 31. Therefore, the trailing portion 32 extending from the meniscus 20 is not pushed out and is not absorbed by the ink droplet 31.

As a result, as shown in FIG. 13, the trailing portion 32 is discrete, and a plurality of ink droplets 33 is formed. Therefore, satellite dots may be formed on the sheet with the plurality of ink droplets 33.

The discharge pulse signal may be composed of the expansion pulse signal and the resting period. The discharge pulse signal may be composed of the expansion pulse signal, the resting period and the contraction pulse signal. The configuration of the discharge pulse signal is not limited to a specific configuration.

The acceleration pulse signal may have a voltage lower than that of the contraction pulse signal. For example, the acceleration pulse signal may have half the voltage of the contraction pulse signal. The voltage and width of the acceleration pulse signal are not limited to specific voltage and width.

The liquid discharge head configured as described above may be included in a liquid applying apparatus. For example, the liquid discharge head may be used to apply a liquid for color filter of a liquid crystal panel, a liquid for an EL (Electro-Luminescence) layer (light emitting layer) of an organic EL panel, a liquid for metal wiring for circuit wiring, a liquid for creation of biochip by DNA (Deoxyribonucleic Acid) or protein, or the like.

In the inkjet head configured as described above, after discharging the ink droplet from the pressure chamber, the flow velocity of the meniscus is increased. Therefore, the inkjet head can push out the trailing portion pulled out by the ink droplet from the meniscus, and the trailing portion can be absorbed by the ink droplet. As a result, the inkjet head can suppress occurrence of the satellite or the mist caused by the trailing portion, thereby improving printing quality.

The inkjet head 100 may be an ink circulation type head. The ink circulation type head discharges the ink supplied from the ink tank and returns the ink not discharged to the ink tank. With the inkjet head of the ink circulation type, it is possible to prevent deterioration of the ink and sedimentation of a color material, thereby further improving the printing quality.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A liquid discharge head, comprising:

an actuator configured to drive a pressure chamber comprising liquid and communicating with a nozzle in which a meniscus of the liquid is formed; and a controller configured to apply an acceleration pulse for accelerating vibration of the meniscus to the actuator after applying a discharge pulse for discharging the liquid in the pressure chamber from the nozzle;

wherein the controller applies the acceleration pulse to the actuator after applying a cancellation pulse for suppressing vibration of the meniscus.

2. The liquid discharge head according to claim 1, wherein the pressure chamber contracts in response to the acceleration pulse.

3. The liquid discharge head according to claim 1, wherein the controller applies the acceleration pulse to the actuator after applying a plurality of discharge pulses.

4. The liquid discharge head according to claim 1, wherein the liquid discharge head is an inkjet head.

5. The liquid discharge head according to claim 1, wherein the actuator comprises a piezoelectric member.

6. The liquid discharge head according to claim 1, wherein the actuator comprises two piezoelectric members.

7. The liquid discharge head according to claim 1, wherein the liquid is ink.

8. The liquid discharge head according claim 1, wherein the acceleration pulse increases flow velocity of the meniscus to a predetermined velocity without discharging the liquid.

9. The liquid discharge head according to claim 8, wherein the acceleration pulse increases the flow velocity of the meniscus from 30% to 65% of a peak of a velocity generated according to the discharge pulse.

10. The liquid discharge head according to claim 8, wherein the acceleration pulse increases the flow velocity of the meniscus from 30% to 65% of a discharge threshold value.

11. A printer, comprising:

a conveyance section configured to convey a medium; and a liquid discharge head, wherein the liquid discharge head comprises:

an actuator configured to drive a pressure chamber comprising a liquid and communicating with a nozzle in which a meniscus of the liquid is formed; and a controller configured to apply an acceleration pulse for accelerating vibration of the meniscus to the actuator after applying a discharge pulse for discharging the liquid in the pressure chamber from the nozzle;

wherein the controller applies the acceleration pulse to the actuator after applying a cancellation pulse for suppressing vibration of the meniscus.

12. The printer according to claim 11, wherein the pressure chamber contracts in response to the acceleration pulse.

13. The printer according to claim 11, wherein the controller applies the acceleration pulse to the actuator after applying a plurality of discharge pulses.

14. The printer according to claim 11, wherein the liquid discharge head is an inkjet head.

15. The printer according to claim 11, wherein the actuator comprises a piezoelectric member.

16. The printer according to claim 11, wherein the actuator comprises two piezoelectric members.

17. The printer according to claim 11, wherein the liquid is ink.

18. A liquid discharge method, comprising:

driving a pressure chamber comprising liquid with an actuator, the actuator communicating with a nozzle in which a meniscus of the liquid is formed;

applying an acceleration pulse for accelerating vibration of the meniscus to the actuator after applying a discharge pulse for discharging the liquid in the pressure chamber from the nozzle; and applying the acceleration pulse to the actuator after applying a cancellation pulse for suppressing vibration of the meniscus.

* * * * *